United States Patent [19]

Dera

[11] 4,110,847

[45] Sep. 5, 1978

[54] QUICK FASTENING AND ADJUSTING SAFETY CLASP ESPECIALLY FOR SAFETY HELMETS

[75] Inventor: Alain Dera, Rueil-Malmaison, France

[73] Assignee: Regie Nationale des Usines Renault, Boulogne-Billancourt, France

[21] Appl. No.: 802,380

[22] Filed: Jun. 2, 1977

[30] Foreign Application Priority Data

Jun. 2, 1976 [FR] France ..... 76 16605

[51] Int. Cl.[2] ..... A42B 7/00

[52] U.S. Cl. ..... 2/421; 24/230 A

[58] Field of Search ..... 2/421; 24/230 A

[56] References Cited

U.S. PATENT DOCUMENTS

| | | | |
|---|---|---|---|
| 423,681 | 3/1890 | Glidden | 24/230 A X |
| 2,513,592 | 7/1950 | Silverman | 24/230 A |
| 3,145,442 | 8/1964 | Brown | 24/230 A |
| 3,235,930 | 2/1966 | Chapin et al. | 24/230 A |
| 3,447,163 | 6/1969 | Bothwell et al. | 2/421 X |
| 3,514,816 | 6/1970 | Inoue | 24/230 A |
| 3,796,461 | 3/1974 | Cucheran et al. | 24/230 A X |
| 3,990,113 | 11/1976 | Coenen | 2/421 |

FOREIGN PATENT DOCUMENTS

| | | | |
|---|---|---|---|
| 280,170 | 12/1930 | Italy | 24/230 A |

*Primary Examiner*—Alfred R. Guest

*Attorney, Agent, or Firm*—Oblon, Fisher, Spivak, McClelland & Maier

[57] ABSTRACT

A rapidly attachable and adjustable safety buckle for a chin strap of a protective helmet having a catch rotatably fixed to the helmet, a hook having one end attached to the chin strap and the other end terminating in a special protuberance, the catch having a cavity therein for receiving the specially shaped protuberance, and means for biasing the buckle toward a closed position with the protuberance being locked into the cavity.

5 Claims, 3 Drawing Figures

QUICK FASTENING AND ADJUSTING SAFETY CLASP ESPECIALLY FOR SAFETY HELMETS

BACKGROUND OF THE INVENTION

1. Field of the Invention

The present invention relates generally to mechanisms for strap buckles, and more particularly to straps for protective helmets.

2. Description of the Prior Art

The most widely used buckle mechanisms of the character described consist of two metal rings. To use this type of buckle, it is necessary to pass the strap through the first ring, loop it around the second ring and bring the end out through the first ring. This is a complex maneuver and is very difficult to do, especially with gloves on.

Occasionally met with are metal devices made of stamped sheet metal which work something like the buckles used on travelling-bags, school sacks and similar items. To make them as light as possible, the manufacturer makes them very small and they become very difficult to manipulate, are aggressive and can scratch and cut. If there is no leather or cloth between the skin and the buckle, they also are uncomfortable.

SUMMARY OF THE INVENTION

Accordingly, it is an object of the present invention to provide a practical and reliable solution to the foregoing problems which may be integrated with the helmet structure.

A further object of the present invention is to provide a mechanism for fast buckling and unbuckling of such strap buckles.

The invention further has an object of providing a low-cost buckle by making it of molded plastic.

The invention is particularly well-suited to the wrap-around helmet of composite structure constituting the object of another patent taken out by the present applicant.

BRIEF DESCRIPTION OF THE DRAWINGS

Other objects, features and attendant advantages of the present invention will be more fully appreciated as the same becomes better understood from the following detailed description, when considered in conjunction with the accompanying drawings, in which like reference numerals designate like or corresponding parts throughout the several figures, and wherein.

DETAILED DESCRIPTION OF THE ILLUSTRATED EMBODIMENT

Figure 2:
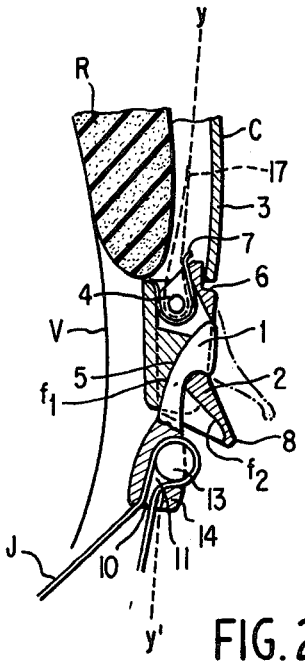
FIG. 2 is a cross section of the mechanism shown in FIG. 1, and taken along the median axis XX' of FIG. 3.

In order better to locate the buckle mechanism, there is shown in FIG. 2 the outline of a face (V), the internal padding (R) of the helmet, the outer shell (C) and the chin-strap (J) of the helmet.

The buckle mechanism of the present invention consists of two main parts, one being a rigid plastic hook 1 molded in the shape of a trapezoid at one end, and the other being a catch 2 of rigid molded plastic attached to the helmet shell 3 for support.

The catch 2 is joined to the support 3 by the intermediary of a cylindrical pin 4 about the axis of which it can pivot and assume either a closed position (solid lines) or an open position (broken line).

The shell, constituting the support for the buckle, has a localized depression 15 molded thereon for installation of the latter. The outer vertical face $f_1$ of this depression is sloped to help guide the hook when it is being inserted in the catch.

Figure 3:
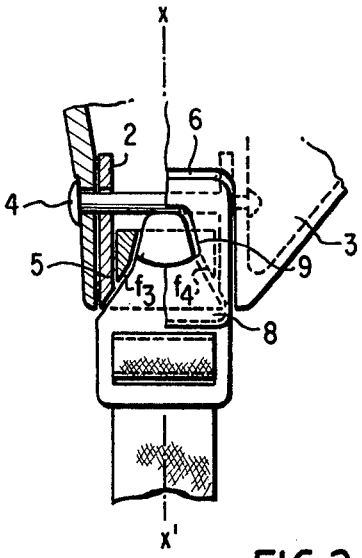
FIG. 3 shows, on the right side, the visible parts of the mechanism, and on the left, a cross section along the axis YY' of FIG. 2.

Similarly, the inside upper surface $f_2$ of the catch, as well as its inner lateral surfaces $f_3$ and $f_4$ (see FIG. 3) are shaped so as to guide the tip of the hook 1 of matching shape and thus to facilitate its engagement in the catch 2. The hook 1 can assume two positions, one being that shown in FIG. 1 and with broken lines in FIG. 2, corresponding to introduction of the hook 1, i.e. the momentary open position of the buckle, and the other being that shown with solid lines in FIG. 2, when the buckle of the invention is closed.

Figure 1:
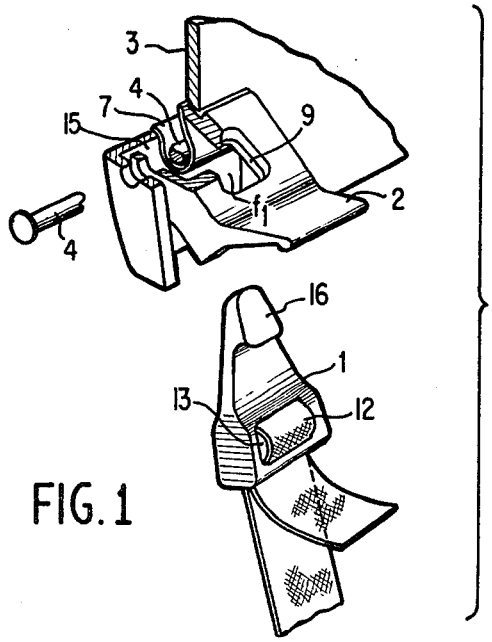
FIG. 1 is an exploded perspective view of the component elements of a buckle formed according to the present invention.

As is clearly shown in FIG. 1, the catch 2 has a central opening 9 into which there is inserted a correspondingly shaped protuberance 16 on the tip of the hook 1 when the buckle is closed.

A spring 7 fitted around the cylindrical axis 4 passes at one end against an edge of the support 3, while its other end exerts a return couple on the catch 2 so as to hold it in the closed position, in which condition the inner surface 5 of the hook rests against the inclined face $f_1$ of the depression 15 in the shell 3.

When it is desired to release the hook 1 from the catch 2, a force is exerted on the inner surface of the end 8 of the catch, in the form of a tab, so as to rotate it about the axis 4, against the force of the spring 7, until an upper shoulder part 6 comes into contact with the support 3. Having done this, the protuberance 16 on the hook 1 is slipped out of the mating opening 9 in the catch 2, thus freeing the chin-strap J.

FIG. 2 shows, at the bottom of the hook 1, the self-tightening mechanism permitting the holding, adjusting and loosening of the chin-strap.

It consists of a slot 10 and a cavity 11 in which a loop 12 of the strap is held captive around a roller 13.

The free end of the strap passes over a sharp edge 14 of the hook, and if the other end of the strap is pulled, the free end becomes locked between the roller and the sharp edge.

If the free end is pulled, the roller "unlocks", turning to release the strap.

To put some "slack" in the tightened strap, it suffices to exert some friction upwards with the thumb and thus to rotate the roller.

It will be noted that a blow from the front cannot cause the buckle to open and that, on the contrary, if the tab 8 is struck first, the tendency is to tighten the catch 2 on the hook 1.

If the support 3 is not strong enough in the region of the cylindrical axis 4 to assure that the helmet will stay on, a better connection can be realized by means of another strap 17 (shown in deshed lines in FIG. 2) which passes around the cylindrical axis 4 and attaches to any rigid part of the helmet.

Obviously, many modifications and variations of the present invention are possible in light of the above teachings. It is to be understood therefore that within the scope of the appended claims this invention may be practiced otherwise than as specifically described herein.

What is claimed as new and desired to be secured by Letters Patent of the United States is:

1. A rapidly attachable and adjustable safety buckle for a chin-strap of a protective helmet, comprising:

a catch molded from rigid plastic and attached at one end to the outer wall of a helmet shell by means of a horizontal axis member allowing limited rotational movement of said catch, an inner face of said catch having a trapezoidal cavity, the sides of which converge towards the horizontal axis, and the outer face of which is pierced at right angles to the said point of convergence by an opening passing through the entire thickness of said catch; and a hook molded from rigid plastic, one end of which is attached to the chin-strap and the other end exhibiting a trapezoidal shape matching that of said cavity in said catch, the other end of the hook terminating in a protuberance fitting the opening which passes through said catch.

2. A safety buckle as set forth in claim 1, further comprising a spring for holding said buckle in the position of closing, one end of said spring pressing against a portion of the helmet shell and being wrapped around the axis member of the catch, and the other end of which exerts a tongue on a zone of the catch causing the buckle to close.

3. A safety buckle as set forth in claim 1, wherein the other end of the catch is in the form of a tab to permit easy manipulation.

4. A safety buckle as set forth in claim 1, wherein the end of the catch next to the horizontal axis member is pierced by a slot permitting passage of a strap looping about said axis for reinforcement, the other ends of the strap being attached to the helmet shell.

5. A safety buckle as set forth in claim 1, wherein the hook has at its base a slot permitting passage of the chin-strap, and in its body a cavity holding a cylindrical roller, around which the end of the chin-strap is looped, the resulting configuration resting on a sharp edge formed by the lower side of the cavity to constitute a self-locking arrangement for the free end of the chin-strap.

* * * * *